US010886118B1

(12) United States Patent
McCauley et al.

(10) Patent No.: US 10,886,118 B1
(45) **Date of Patent: *Jan. 5, 2021**

(54) ION SOURCE WITH MIXED MAGNETS

(71) Applicant: Thermo Finnigan LLC, San Jose, CA (US)

(72) Inventors: Edward B. McCauley, Cedar Park, TX (US); Deven L. Shinholt, Hutto, TX (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/589,964

(22) Filed: Oct. 1, 2019

Related U.S. Application Data

(63) Continuation of application No. 15/937,803, filed on Mar. 27, 2018, now Pat. No. 10,490,396.

(60) Provisional application No. 62/478,003, filed on Mar. 28, 2017.

(51) Int. Cl.

| | |
|---|---|
| ***H01J 49/20*** | (2006.01) |
| ***H01J 49/26*** | (2006.01) |
| ***H01J 49/14*** | (2006.01) |
| ***H01J 49/06*** | (2006.01) |

(52) U.S. Cl.
CPC ..... *H01J 49/20* (2013.01); *H01J 49/063* (2013.01); *H01J 49/147* (2013.01); *H01J 49/26* (2013.01)

(58) Field of Classification Search
CPC ..... H01J 49/20; H01J 49/26; H01J 49/063; H01J 49/147
USPC ..... 250/281, 282, 283, 288, 423 R, 423 F, 250/423 P, 424
See application file for complete search history.

(56) References Cited

U.S. PATENT DOCUMENTS

| | | | | |
|---|---|---|---|---|
| 5,726,838 | A | 3/1998 | Soeya et al. | |
| 5,855,745 | A | 1/1999 | Manley | |
| 7,060,987 | B2 | 6/2006 | Lee et al. | |
| 9,721,777 | B1 | 8/2017 | Muntean | |
| 10,490,396 | B1 * | 11/2019 | McCauley | H01J 49/147 |
| 2014/0375209 | A1 | 12/2014 | Russ et al. | |
| 2015/0373826 | A1 | 12/2015 | Knoll et al. | |
| 2016/0172146 | A1 | 6/2016 | Wang | |

OTHER PUBLICATIONS

Miyamoto et al., "Development of a new electron ionization/fieldionization ion source for gas chromatography/time-of-flight mass spectrometry", Rapid Commun. Mass Spectrom. 2009, 23, pp. 3350-3354.

Non-Final Office action dated Mar. 22, 2019, to U.S. Appl. No. 15/937,803.

O'Connor, Peter B., "Considerations for design of a Fourier transform mass spectrometer in the 4.2 K cold bore of a superconducting magnet", Rapid Comm. Mass Spectrom. (2002}, vol. 16, pp. 1160-1167.

Yue et al., "Superimposition of a Magnetic Field around an Ion Guide for Electron Ionization Time-of-Flight Mass Spectrometry", Anal. Chem. 2005, 77, pp. 4167-4175.

* cited by examiner

*Primary Examiner* — Nicole M Ippolito

(57) ABSTRACT

A magnet assembly for an ion source comprising a first magnet of a first magnet type; a second magnet of a second magnet type; a heat shield located between the first magnet and the second magnet; and a heat sink coupled to the heat shield; wherein the first magnet type having a higher Curie temperature than the second magnet type.

14 Claims, 6 Drawing Sheets

ION SOURCE WITH MIXED MAGNETS

CROSS-REFERENCE TO RELATED APPLICATIONS

The present application is a continuation under 35 U.S.C. § 120 of co-pending U.S. patent application Ser. No. 15/937,803, filed Mar. 27, 2018. U.S. patent application Ser. No. 15/937,803, claims the priority benefit of U.S. Provisional Application No. 62/478,003, filed Mar. 28, 2017. The disclosure of the foregoing application is incorporated herein by reference.

FIELD

The present disclosure generally relates to the field of mass spectrometry including a ion source with mixed magnets.

INTRODUCTION

Mass spectrometry can be used to perform detailed analyses on samples. Furthermore, mass spectrometry can provide both qualitative (is compound X present in the sample) and quantitative (how much of compound X is present in the sample) data for a large number of compounds in a sample. These capabilities have been used for a wide variety of analyses, such as to test for drug use, determine pesticide residues in food, monitor water quality, and the like.

Sensitivity of a mass spectrometer can be limited by the efficiency of the ion source, ion losses through the mass spectrometer and in the mass analyzer, and sensitivity of the detector. Increasing the efficiency of the ion source, the number of ions produced per unit sample or per unit time, can significantly improve the detection limits of the mass spectrometer, enabling the detection of lower concentrations of compounds or the use of smaller amounts of sample. As such, there is a need for improved ion sources.

SUMMARY

In a first aspect, a magnet assembly for an ion source can include a first magnet of a first magnet type; a second magnet of a second magnet type; a heat shield located between the first magnet and the second magnet; and a heat sink coupled to the heat shield. The first magnet type can have a higher Curie temperature than the second magnet type.

In various embodiments of the first aspect, the first magnet type can have a lower temperature coefficient than the second magnet type.

In various embodiments of the first aspect, the second magnet type can have a higher remanence than the first magnet type.

In various embodiments of the first aspect, the magnet assembly can include a third magnet oriented such that south face of the third magnet is pointing in the opposite direction from the south face of the second magnet or the first magnet to form a temperature compensated magnet assembly.

In a second aspect, an ion source for a mass spectrometer can include a body, an electron source, a magnet assembly, and a lens element. The body can include an ionization chamber at a first end, a sample inlet into the ionization chamber. The body can have a length along a source axis from the first end to a second end. The electron source can be positioned at the first end. The electron source can include a thermionic filament, and the electron source can be configured for accelerating an electron beam through the ionization chamber along the source axis. The magnet assembly can be configured for generating an axial magnetic field in the ionization chamber. The magnet assembly can be located adjacent to electron source opposite from the ionization chamber and aligned with the source axis. The magnet assembly including a first magnet of a first type and a second magnet of a second type. The first magnet type can have a higher Curie temperature than the second magnet type. The lens element can be positioned at the second end and can be configured to reflect electrons back along the source axis towards the electron source.

In various embodiments of the second aspect, the ion source can further include an RF multipole extending from the lens element. In particular embodiments, the multipole can be an RF ion guide.

In various embodiments of the second aspect, the first magnet type can have a lower temperature coefficient than the second magnet type.

In various embodiments of the second aspect, the second magnet type can have a higher remanence than the first magnet type.

In various embodiments of the second aspect, the body can further a post ionization volume at a second end.

In various embodiments of the second aspect, the electron source can further include a repeller configured to repel ions produced in the ionization volume away from the electron source.

In various embodiments of the second aspect, the magnet assembly can include a third magnet oriented such that south face of the third magnet is pointing in the opposite direction from the south face of the second magnet or the first magnet to form a temperature compensated magnet assembly.

In a third aspect, a mass spectrometer can include an ion source, and a mass analyzer for determining the mass-to-charge ratio of ions produced by the ion source. The ion source can include a body, an electron source, a magnet assembly, and a lens element. The body can include an ionization chamber at a first end and a sample inlet into the ionization chamber. The body can have a length along a source axis from the first end to a second end. The electron source can be positioned at the first end. The electron source can include a thermionic filament and the electron source can be configured for accelerating an electron beam through the ionization chamber along the source axis. The magnet assembly can be configured for generating an axial magnetic field in the ionization chamber and can be located adjacent to electron source opposite from the ionization chamber and aligned with the source axis. The magnet assembly can include a first magnet of a first type and a second magnet of a second type. The first magnet type can have a higher Curie temperature than the second magnet type. The lens element can be positioned at the second end and can be configured to reflect electrons back along the source axis towards the electron source.

In various embodiments of the third aspect, the ion source further comprises an RF multipole extending from the lens element.

In various embodiments of the third aspect, the multipole is an RF ion guide.

In various embodiments of the third aspect, the mass analyzer is a quadrupole mass filter, an ion trap, an electrostatic mass analyzer, a time of flight mass analyzer, or any combination thereof.

In various embodiments of the third aspect, the first magnet type has a lower temperature coefficient than the second magnet type.

In various embodiments of the third aspect, the second magnet type has a higher remanence than the first magnet type.

In various embodiments of the third aspect, the body further comprising a post ionization volume at a second end.

In various embodiments of the third aspect, the electron source further comprising a repeller configured to repel ions produced in the ionization volume away from the electron source.

In various embodiments of the third aspect, the magnet assembly can include a third magnet oriented such that south face of the third magnet is pointing in the opposite direction from the south face of the second magnet or the first magnet to form a temperature compensated magnet assembly.

In a forth aspect, a temperature compensated magnet assembly for an ion source can include a first magnet of a first magnet type; and a second magnet of a second magnet type. The first magnet and the second magnet can be oriented such that the south face of the first magnet is pointing in the opposite direction from the south face of the second magnet.

DRAWINGS

For a more complete understanding of the principles disclosed herein, and the advantages thereof, reference is now made to the following descriptions taken in conjunction with the accompanying drawings and exhibits, in which.

Figure 1:
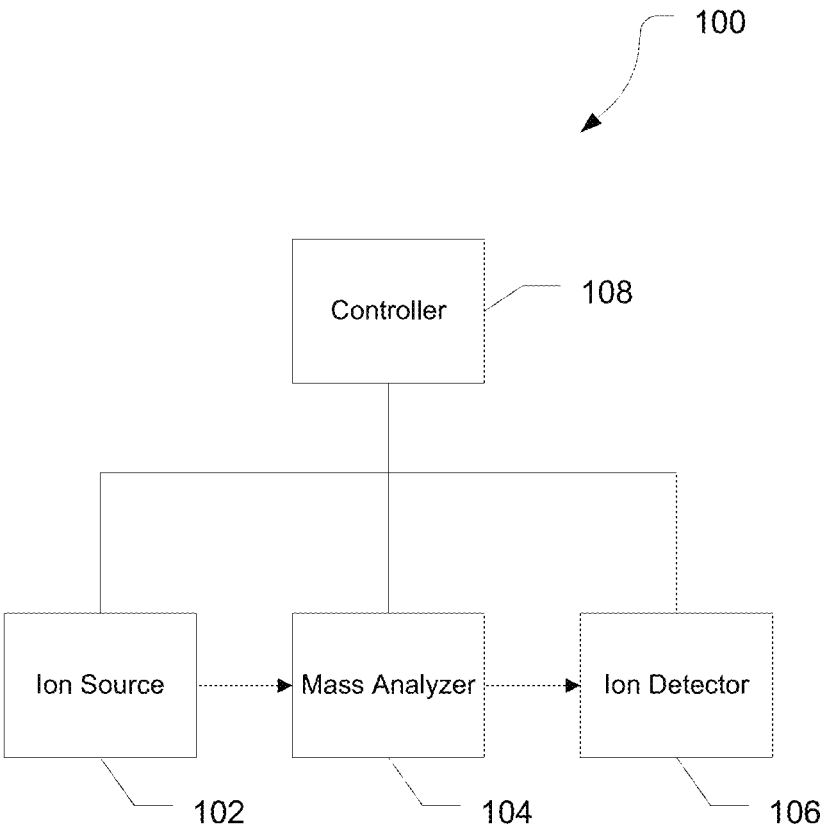
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., ORBITRAP) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Ion Source

Figure 2A:
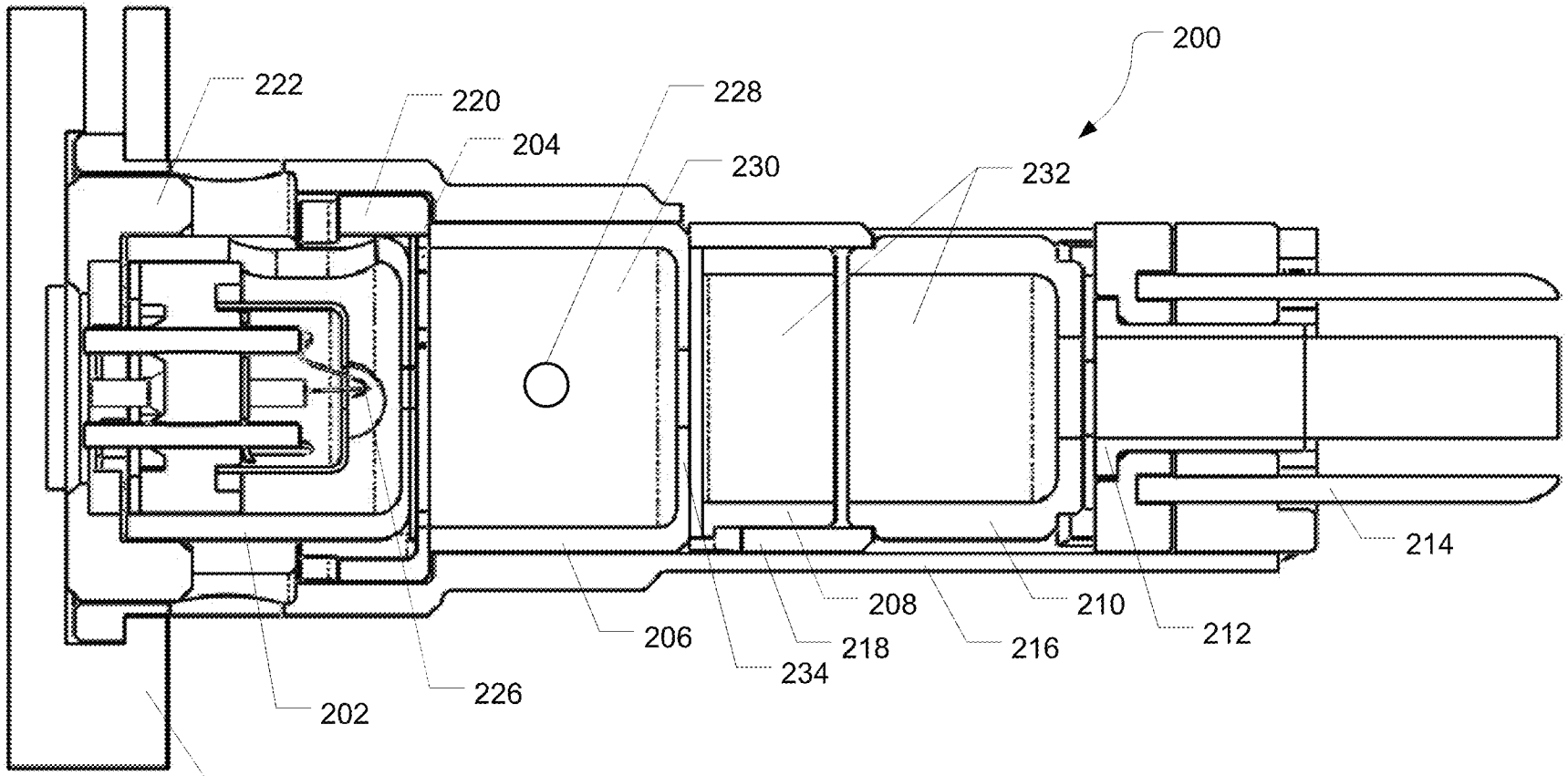
FIGS. 2A and 2B are diagrams illustrating an exemplary ion source, in accordance with various embodiments.
Figure 2B:
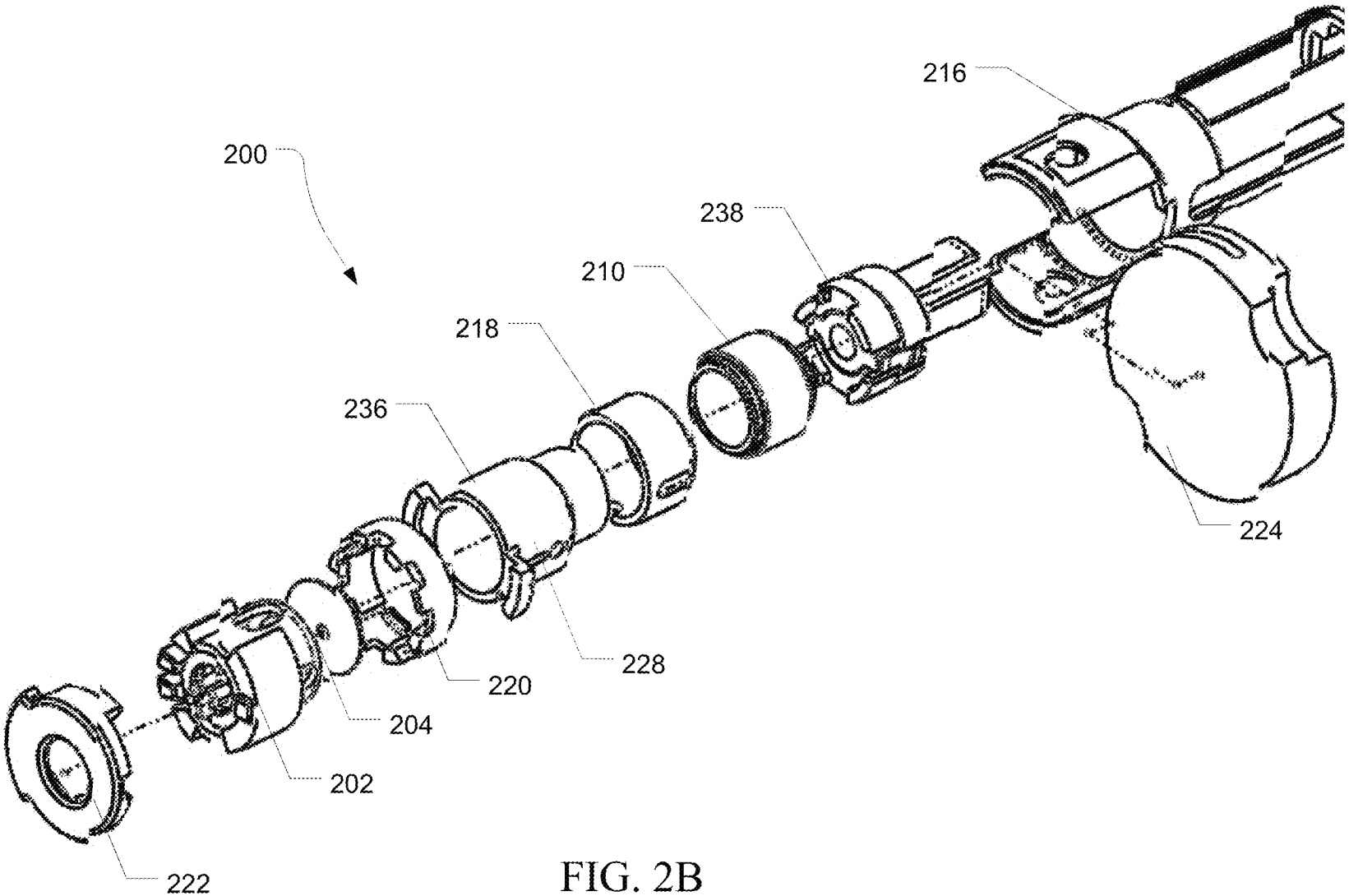

FIGS. 2A and 2B are diagrams illustrating an ion source 200, which can be used as ion source 102 of mass spectrometry platform 100. Ion source 200 can include an electron source 202, an electron lens 204, an ionization chamber 206, lens elements 208, 210, and 212, and RF ion guide 214. Additionally, ion source 200 can include a body 216, insulator 218, spacers 220 and 222, and retaining clip 224.

Electron source 202 can include a thermionic filament 226 for the generation of electrons. In various embodiments, electron source 202 can include more additional thermionic filaments for redundancy or increased electron production. In alternate embodiments, electron source 202 can include a field emitter. The electrons can travel axially along ion source 200 into ionization chamber 206 to ionize gas molecules. Electron lens 204 can serve to prevent the ions from traveling back towards the electron source.

Ionization chamber 206 can include gas inlet 228 for directing a gas sample into an ionization volume 230 defined by the ionization chamber 206. Gas molecules within the ionization volume 230 can be ionized by the electrons from the thermionic filament 226. Lenses 208 and 210 can define a post ionization volume 232. Post ionization volume 232 can be a region where ions can be formed which has a lower pressure for the sample. Post ionization volume 232 can include regions of the lenses where electrons are present. In various embodiments, it may also include areas outside of the ionization volume and the lenses. Wall 234 can restrict the flow of gas from ionization volume 230 to the post ionization volume 232, creating a substantial pressure difference between the ionization volume 230 and post ionization volume 232. While ionization can occur in post ionization volume 232, significantly more ions can be generated in ionization volume 230 due to the lower sample density in the post ionization volume 232.

In various embodiments, the ionization chamber 206 and lens element 208 can be joined to create an extended ionization element 236 defining the ionization volume 230 and at least a portion of the post ionization volume 232. In such embodiments, lens element 208 can be electrically coupled to ionization chamber 206. In other embodiments, the joined ionization chamber 206 and lens element 208 can be electrically isolated, such that different voltage potentials can be applied to the ionization chamber 206 and the lens element 208.

Lens 210 and 212 and RF ion guide 214 can assist in the axial movement of ions from the ionization volume 230 to additional ion optical elements and mass analyzer 104 of mass spectrometry platform 100. In various embodiments, ion guide assembly 238 can include lens 212 and RF ion guide 214. Ion guide assembly 238 can include additional insulating portions to electrically isolate lens 212 from RF ion guide 214. Additionally, the insulating portions can include standoffs to prevent electrical contact between lens 210 and lens 212.

When assembled into body 216, insulator 218 can prevent electrical contact between lens 208 (or extended ionization element 236) and lens 210. Spacers 220 can prevent electrical contact between electron lens 204 and ionization chamber 208 (or extended ionization element 236). Spacer 222 can be indexed to prevent rotation of the electron source 202, and retaining clip 224 can hold the other components within body 216.

Dual Magnets

Figure 3:
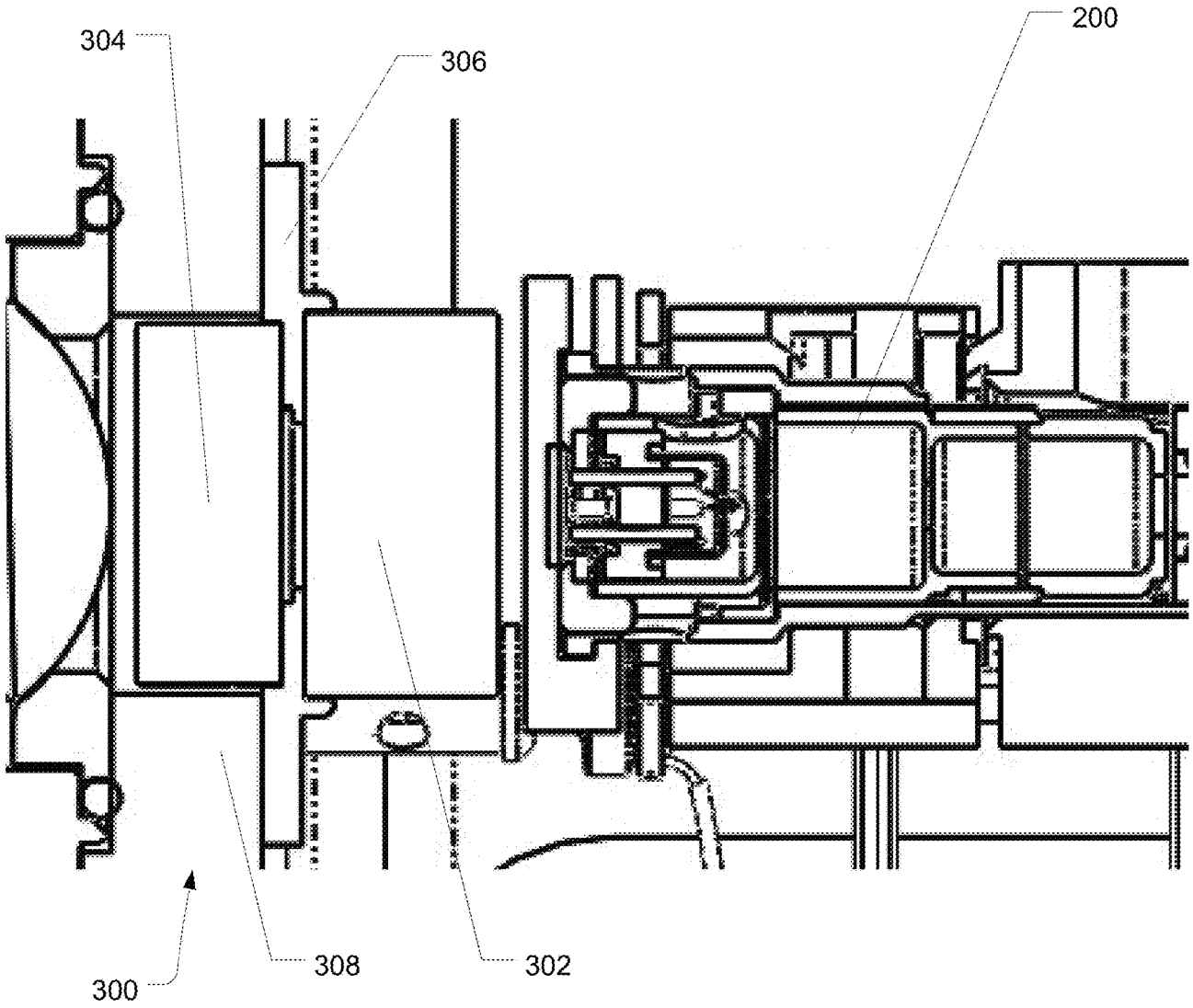
FIG. 3 is a diagram illustrating an exemplary magnet arrangement for use with the exemplary ion source, in accordance with various embodiments.

FIG. 3 is a diagram illustrating a magnet assembly 300 for use with source 200. The magnet assembly 300 can include a magnet 302, magnet 304, magnet holder 306, and heat sink 308. Magnets 302 and 304 can produce a magnetic field that is substantially axial to the ion source 200. The magnetic field can guide or contain electrons axially within source 200.

In operation, the ion source 200 can be maintained at an elevated temperature, such as between 150 C and 350 C, such as about 250 C. In various embodiments, the elevated temperature of the ion source 200 can lead to demagnetization of magnets if the Curie temperature of the magnet is exceeded. Additionally, the magnetic strength can have a temperature dependency, as defined by the temperature coefficient on the magnetic material. Magnet 302 can be of a magnet material that has a high Curie temperature, such as a samarium-cobalt magnet or aluminum-nickel-cobalt magnet, and can be capable of withstanding the temperatures of the ion source 200. Additionally, the magnetic material of magnet 302 can have a low temperature coefficient, reducing the variability of the magnetic field when the temperature of the ion source 200 is changed. To further protect magnet 302 from elevated temperatures and to reduce the effect of changing temperatures in the ion source 200, magnet 302 can be in thermal contact with the magnet holder 306. Magnet holder 306 can be made of a material that is non-ferromagnetic and has a high thermal conductivity, such as aluminum. Magnet holder 306 can also be in thermal contact with heat sink 308. In various embodiments, heat sink 308 can be a door or wall of the vacuum chamber housing the source. Heat sink 308 can have a high thermal mass and can have a mechanism for heat loss, such as to the environment exterior to the vacuum chamber. Heat sink 308 can be made of a material that is non-ferromagnetic and has a high thermal conductivity, such as aluminum. Additionally, heat sink 308 can have a high thermal mass and high specific heat.

Magnet 304 can be thermally shielded from the source by the magnet holder 306 and heat sink 308. As such, magnet 304 may be of a magnet material that is less limited by the temperature coefficient and Curie temperature. In various embodiments, magnet 302 can have a higher Curie temperature and lower temperature coefficient than magnet 304. In further embodiments, the material of magnet 304 can be chosen for high magnetic strength (remanence), such that magnet 304 can have a higher remanence than magnet 302. In various embodiments, magnet 304 can be a neodymium-iron-boron magnet.

The combination of a high Curie temperature/low temperature coefficient magnet 302 that is more exposed to the heat of ion source 200 and a higher strength magnet 304 that is more isolated from the heat of the ion source can result in an increased axial magnetic field in the ion source. In various embodiments, magnet 304 can be arranged to reinforce magnet 302, such as by orienting magnet 304 so that the north face of magnet 304 is pointing towards the south face of magnet 302.

In other embodiments, magnet 304 can be arranged to oppose magnet 302, such as by orienting magnet 304 so that the south face of magnet 304 is pointing towards the south face of magnet 302. In this arrangement, the magnets can be temperature compensated, such that there is less temperature dependence for the magnetic field. In such an arrangement, it may be beneficial to use two or more magnets in the location of magnet 304 with at least one magnet arranged to oppose magnet 302 and at least one magnet arranged to reinforce magnet 302.

Figure 4:
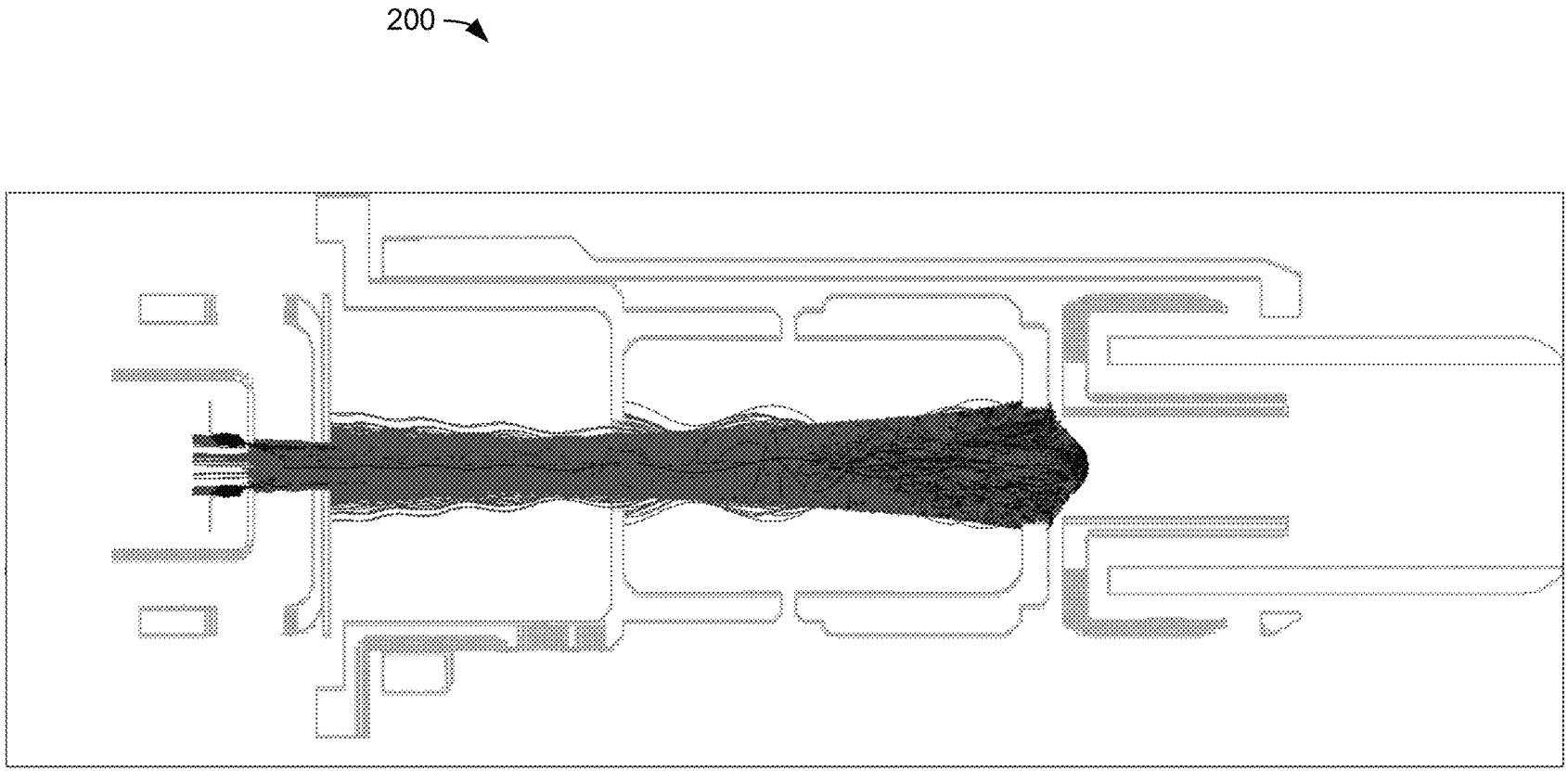
FIG. 4 is a diagram illustrating a simulation of electrons in an ion source, in accordance with various embodiments.

FIG. 4 is an illustration of a simulation of electrons in ion source 200 with forced electrostatic reflection of the electrons. The electrons can be electrostatically reflected by lens element 212 when the lens potential is sufficiently more negative on its axis than the electron energy of the electrons produced in the electron source 202. Potentials used for the simulation are shown in FIG. 4 and Table 1. In various embodiments, filament 226 can have a potential of between about −40V and −80V, such as about −45 V, and electron lens 204 can have a potential between about 0 V to about 15 V, such as between about 5 V and about 7 V. Ionization chamber 206 and lens element 208 can be grounded (about 0 V), and lens element 210 can have a potential of between about 0 V and about −15 V, such as between about −2 V and about −10 V. Lens element 212 can have a potential of between about −50 V and about −150 V, and RF ion guide 214 can have an offset voltage of about −15 V to about 1 V. In other embodiments, filament 226 can have a potential of about −70 V and lens element 212 can have a potential of between about −83 V and about −150 V.

TABLE 1

| Electrostatic Reflection | | | |
|---|---|---|---|
| | Simulation | Alternative 1 | Alternative 2 |
| Filament 226 | −70 V | −45 V | −70 V |
| Electron Lens 204 | 6 V | 0 V to 15 V | 0 V to 15 V |
| Ionization Chamber 206 | 0 V (grounded) | 0 V (grounded) | 0 V (grounded) |
| Lens 208 | 0 V (grounded) | 0 V (grounded) | 0 V (grounded) |
| Lens 210 | −10 V | 0 V to −15 V | 0 V to −15 V |
| Lens 212 | −83 V | −50 V to −150 V | −83 V to −150 V |
| RF Ion Guide 214 | −4.3 V | −15 V to 1 V | −15 V to 1 V |

Computer-Implemented System

Figure 5:
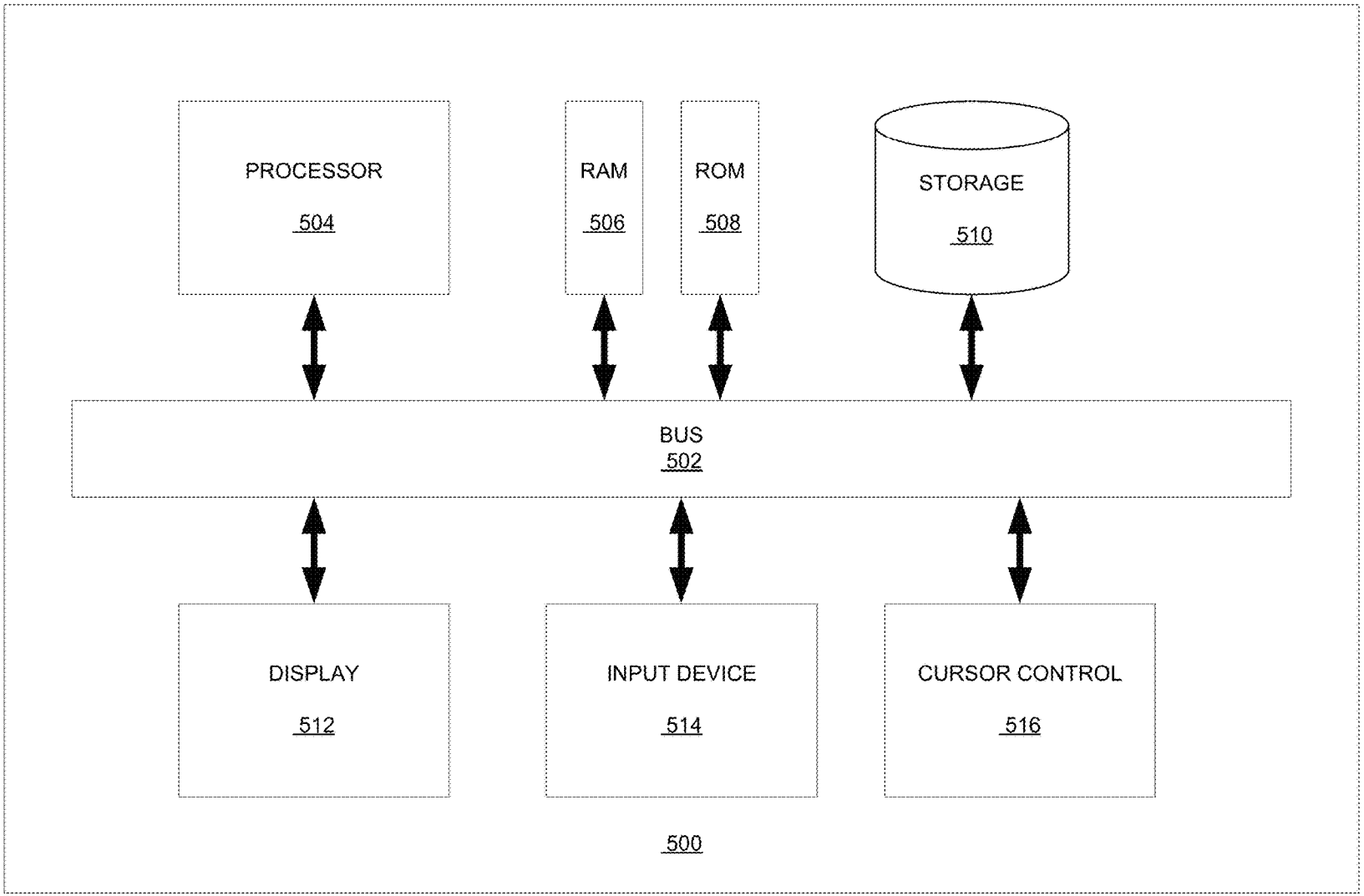
FIG. 5 is a block diagram illustrating an exemplary computer system.

FIG. 5 is a block diagram that illustrates a computer system 500, upon which embodiments of the present teachings may be implemented as which may incorporate or communicate with a system controller, for example controller 58 shown in FIG. 1, such that the operation of components of the associated mass spectrometer may be adjusted in accordance with calculations or determinations made by computer system 500. In various embodiments, computer system 500 can include a bus 502 or other communication mechanism for communicating information, and a processor 504 coupled with bus 502 for processing information. In various embodiments, computer system 500 can also include a memory 506, which can be a random access memory (RAM) or other dynamic storage device, coupled to bus 502, and instructions to be executed by processor 504. Memory 506 also can be used for storing temporary variables or other intermediate information during execution of instructions to be executed by processor 504. In various embodiments, computer system 500 can further include a read only memory (ROM) 508 or other static storage device coupled to bus 502 for storing static information and instructions for processor 504. A storage device 510, such as a magnetic disk or optical disk, can be provided and coupled to bus 502 for storing information and instructions.

In various embodiments, computer system 500 can be coupled via bus 502 to a display 512, such as a cathode ray tube (CRT) or liquid crystal display (LCD), for displaying information to a computer user. An input device 514, including alphanumeric and other keys, can be coupled to bus 502 for communicating information and command selections to processor 504. Another type of user input device is a cursor control 516, such as a mouse, a trackball or cursor direction keys for communicating direction information and command selections to processor 504 and for controlling cursor movement on display 512. This input device typically has two degrees of freedom in two axes, a first axis (i.e., x) and a second axis (i.e., y), that allows the device to specify positions in a plane.

A computer system 500 can perform the present teachings. Consistent with certain implementations of the present teachings, results can be provided by computer system 500 in response to processor 504 executing one or more sequences of one or more instructions contained in memory 506. Such instructions can be read into memory 506 from another computer-readable medium, such as storage device 510. Execution of the sequences of instructions contained in memory 506 can cause processor 504 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 504 for execution. Such a medium can take many forms, including but not limited to, non-volatile media, volatile media, and transmission media. Examples of non-volatile media can include, but are not limited to, optical or magnetic disks, such as storage device 510. Examples of volatile media can include, but are not limited to, dynamic memory, such as memory 506. Examples of transmission media can include, but are not limited to, coaxial cables, copper wire, and fiber optics, including the wires that comprise bus 502.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD- ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

What is claimed is:

1. A magnet assembly for an ion source comprising:

a first magnet of a first magnet type having a first Curie temperature;

a second magnet of a second magnet type having a second Curie temperature, the first curie Temperature and the second Curie temperature being different;

a heat shield located between the first magnet and the second magnet; and a heat sink coupled to the heat shield.

2. The magnet assembly of claim 1, wherein the first magnet type has a lower temperature coefficient than the second magnet type.

3. The magnet assembly of claim 1, wherein the second magnet type has a higher remanence than the first magnet type.

4. The magnet assembly of claim 1, further comprising:

a third magnet oriented such that a south face of the third magnet is pointing in an opposite direction from a south face of the second magnet or the first magnet to form a temperature compensated magnet assembly.

5. The magnet assembly of claim 1, wherein a first face of the first magnet is pointed in a direction towards a second face of the second magnet, one of the first face or the second face being a north magnetic pole, the other being a south magnetic pole.

6. The magnet assembly of claim 1, wherein a first face of the first magnet is pointed in a direction towards a second face of the second magnet, the first face and the second face both being a north magnetic pole or a south magnetic pole.

7. The magnet assembly of claim 1, wherein the first Curie temperature is higher than the second Curie temperature.

8. An ion source comprising:

a thermionic filament for generating electrons;

a magnet assembly for guiding the electrons, the magnet assembly having:

a first magnet of a first magnet type, a second magnet of a second magnet type, the first magnet type and the second magnet type being different, a heat shield located between the first magnet and the second magnet, and a heat sink coupled to the heat shield.

9. The ion source of claim 8, wherein the first magnet type has a higher Curie temperature than the second magnet type.

10. The ion source of claim 8, wherein the first magnet type has a lower temperature coefficient than the second magnet type.

11. The ion source of claim 8, wherein the second magnet type has a higher remanence than the first magnet type.

12. The ion source of claim 8, wherein the magnet assembly further includes:

a third magnet oriented such that a south face of the third magnet is pointing in an opposite direction from a south face of the second magnet or the first magnet to form a temperature compensated magnet assembly.

13. The ion source of claim 8, wherein a first face of the first magnet is pointed in a direction towards a second face of the second magnet, one of the first face or the second face being a north magnetic pole, the other being a south magnetic pole.

14. The ion source of claim 8, wherein a first face of the first magnet is pointed in a direction towards a second face of the second magnet, the first face and the second face both being a north magnetic pole or a south magnetic pole.

* * * * *